US005808423A

United States Patent [19]

Li et al.

[11] Patent Number: 5,808,423

[45] Date of Patent: Sep. 15, 1998

[54] LIGHTING CONTROL FOR REDUCING ENERGY CONSUMPTION

[75] Inventors: Richard Qun Li, Westminster; John Wei-Fan Chou, Montery Park; Yongping Xia, Torrance, all of Calif.; Ronald Siepkes, Eindhoven, Netherlands

[73] Assignee: Philips Electronics North America Corporation, New York, N.Y.

[21] Appl. No.: 762,621

[22] Filed: Dec. 9, 1996

Related U.S. Application Data

[63] Continuation of Ser. No. 644,476, May 10, 1996, abandoned.

[51] Int. Cl.[6] ..... H05B 37/00

[52] U.S. Cl. ..... 315/313; 315/362; 315/360; 307/38; 307/115; 307/140

[58] Field of Search ..... 315/313, 312, 315/315, 316, 321–324, 209 R, 276, 289, 360, 362, DIG. 4; 307/38, 39, 115, 116, 139, 140; 363/128, 160

[56] References Cited

U.S. PATENT DOCUMENTS

| | | | |
|---|---|---|---|
| 3,935,505 | 1/1976 | Spiteri | 315/194 |
| 4,207,497 | 6/1980 | Capewell et al. | 315/96 |
| 4,322,632 | 3/1982 | Hart et al. | 315/322 X |
| 4,766,353 | 8/1988 | Burgess | 315/324 |
| 4,879,495 | 11/1989 | Yamamoto | 315/362 |
| 4,896,079 | 1/1990 | Tabor | 315/313 |
| 5,610,448 | 3/1997 | Dattilo | 315/313 X |

FOREIGN PATENT DOCUMENTS

| | | |
|---|---|---|
| WO9425912 | 11/1994 | WIPO . |
| WO9603850 | 2/1996 | WIPO . |

*Primary Examiner*—Robert J. Pascal
*Assistant Examiner*—Haissa Philogene

[57] ABSTRACT

A lighting control circuit that controls the lighting of particular lamps in response to the toggling of the power switch. The circuit a) connects only with the high (output) side of a lighting system's ballast, b) is completely contained on the high side, and c) with regard to toggling, is dependent upon only a single time period. The circuit can be used with any ballast which makes use of an output transformer and no change need be made to the original ballast circuitry. Users will find operation of the circuit to be straightforward. A triac driven by a flip-flop via a driver transistor is used to control the high frequency AC power that is used to drive the lamps. A Schmitt trigger sharpens the signal generated by the ballast output transformer in response to the toggling of the light switch which is employed to change the output state of the flip-flop. Operationally, all the lamps driven by the ballast are lit when the power switch is initially turned on. Toggling the power switch once while all of the lamps are lit causes only a predetermined number of the lamps to remain lit. Toggling the power switch while only a portion of the lamps are lit causes all of the lamps to light again. Leaving the power switch off causes all of the lamps to be turned off. The toggling may be performed quickly or leisurely, so long as the entire toggle cycle is completed within a predetermined amount of time.

24 Claims, 4 Drawing Sheets

LIGHTING CONTROL FOR REDUCING ENERGY CONSUMPTION

This application is a continuation of Ser. No. 08/644,476, filed May 10, 1996, abandoned.

TECHNICAL FIELD

This invention relates to the field of fluorescent lighting systems, and more particularly, to an energy conserving lighting control system for use in such systems in conjunction with their electronic ballasts.

BACKGROUND OF THE INVENTION

To save energy, California Title 24 requires a building's lighting system to meet at least one of the following criteria: a) the light intensity is limited to a specified level; b) the light is dimmable; or c) half of the fixtures may be turned off, e.g., via an extra switch. Meeting these requirements is not easy when the lighting system employed is a fluorescent lighting system, especially when the lighting system is installed in an already completed building. This is because, for example, the light level currently existent in many office buildings lit with fluorescent lighting exceeds the level specified by Title 24, and so only options (b) and (c) are available. If it is desired to make the light dimmable by installing a dimming ballast, it may be necessary to install extra wires to enable such use. If one desires to meet the requirements of Title 24 by installing another switch to turn off half of the fixtures, in some situations space limitations may make installation of another switch prohibitive. Furthermore, installation of dimming ballasts or extra switches necessitates the rewiring of the light installation, which can be very costly.

One simple prior art method to meet the requirements of Title 24 without using an extra switch or additional wire is the so-called "toggle method". According to this method, a lighting installation is lit at full brightness when its associated switch is turned on for the first time. The light level is then reduced if the switch is toggled, i.e., switched off and on again, within a certain amount of time. There are several products available on the market which employ the toggle method. However, they either 1) require the installation of extra wiring, thus insignificantly increasing the system cost, especially for locations having already installed lighting that must be retrofitted; or 2) the toggle time, e.g., the length of time that the switch is off prior to being turned on again, is critical, and as a result, operation is confusing to users. For example, it may be required that the toggle switch be turned off for more than half a second and then be turned on again within another predetermined time period.

SUMMARY OF THE INVENTION

The foregoing problems with the toggle method are overcome by employing a lighting control circuit that a) connects only with the high (output) side of a lighting system's ballast, b) is completely contained on the high side, and c) with regard to toggling, is dependent upon only a single time period. Advantageously, 1) the circuit can be used with any ballast which makes use of an output transformer, 2) no change need be made to the original ballast circuitry, and 3) users will find operation of the circuit to be straightforward.

In one embodiment of the invention, a triac is used to control the high frequency, e.g., 20,000 or more hertz, alternating current (AC) power that is used to drive the lamps. The triac is driven by a flip-flop via a driver transistor. A Schmitt trigger is used to sharpen the signal generated by the ballast output transformer in response to the toggling of the light switch, and the sharpened signal is employed to change the output state of the flip-flop controlling the triac. The Schmitt trigger may be constructed from an available extra flip-flop of the same type that is used to control the triac.

Operationally, with such an embodiment of the circuit of the invention attached, all the lamps driven by the ballast are lit when the power switch is initially turned on. Toggling the power switch once while all of the lamps are lit causes only a predetermined number of the lamps, e.g., half of them, to remain lit. If the power switch is toggled while only a portion of the lamps are lit, all of the lamps are lit once again. Turning the power switch off and leaving it off causes all of the lamps to be turned off. Unlike prior art systems, the timing of the phases of the toggling action is not critical. Instead, the toggling may be performed quickly or leisurely, so long as the entire toggle cycle is completed within a predetermined amount of time, e.g., 5 seconds.

Thus, one can appreciate additional advantages of the invention, which are, a) the fact that one wall switch can control multiple ballasts and/or multiple lamps and b) no extra wire or extra switches are required in the installation of the power switch and ballast. Thus, the invention provides a low cost solution for light intensity control, e.g., toward the goal of meeting the requirements of Title 24.

The principles of the invention may be employed with multiple lamps to develop various sequences of lamp lighting patterns as the power switch is toggled.

DETAILED DESCRIPTION

Figure 1:
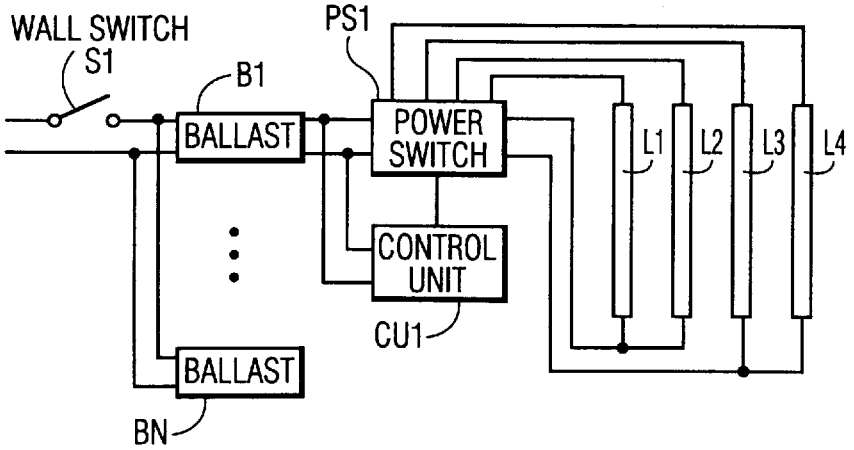
FIG. 1 shows a block diagram of a lighting system which includes an exemplary embodiment of the invention.

FIG. 1 shows a block diagram of a lighting system which includes an exemplary embodiment of the invention. As shown, wall switch S1 controls multiple ballasts B1 . . . BN. In accordance with the principles of the invention, the output of ballast B1 is coupled as an input to each of power switch PS1 and control unit CU1. Control unit CU1 determines how many of lamps L1 . . . L4 should be lit as a function of the operation of wall switch S1. Power switch PS1 causes the number of lamps determined by control unit CU1 to be lit in response to commands from control unit CU1 and the presence or absence of lamp drive power at the output of ballast B1. Each ballast and lamp set may be independently controlled by their own control unit and power switch (not shown). In accordance with an aspect of the invention, each control unit and power switch may control which of their lamps are lit independent of any other control units or power switch units, even ones that are connected to the same wall switch.

Figure 2:
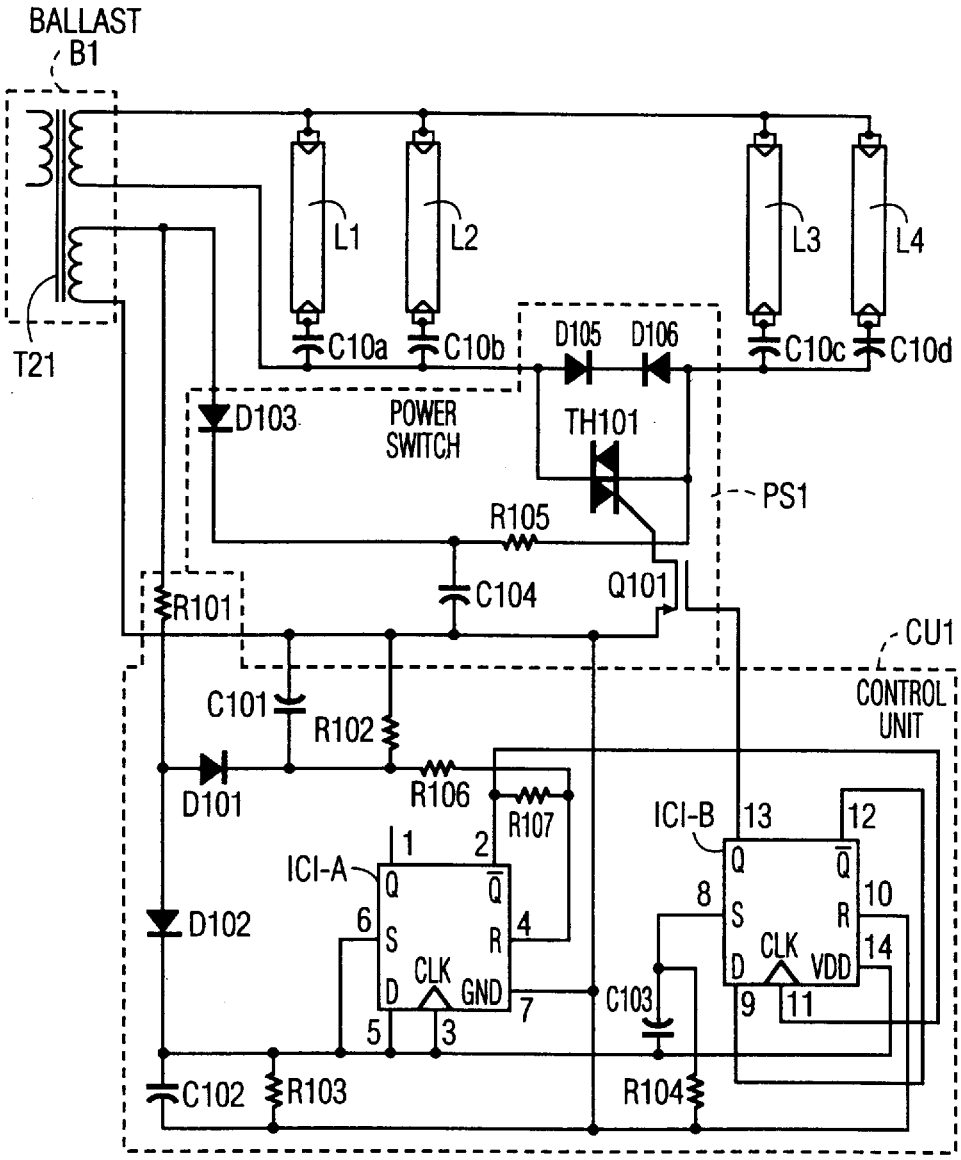
FIG. 2 shows an exemplary embodiment of the invention for a four lamp instant start electronic ballast.

FIG. 2 shows an exemplary embodiment of the invention for a four lamp instant start electronic ballast. In this embodiment, lamps L1 and L2 are driven by ballast output transformer T21 of ballast B1 via capacitors C10A and C10B. Thus, the lighting state of lamps L1 and L2 corresponds directly to the output presence of lamp drive power at the of ballast output transformer T21. However, in accordance with an aspect of the invention, the lighting of lamps L3 and L4 is controlled by triac TH101 in conjunction with the output of ballast transformer T21. When triac TH101 is on in the presence of an output voltage supplied by ballast output transformer T21, lamps L3 and L4 are lit. Otherwise, lamps L3 and L4 are off. Note that ballast output transformer T21 has two secondary windings.

In more detail, diode D103 and capacitor C104 provide a direct current (DC) voltage for driving triac TH101. Resistor R105 limits the triac drive current. Metal oxide semiconductor field effect transistor (MOSFET) Q101 controls the trigger input of triac TH101. When the gate of MOSFET Q101 has a high voltage supplied as an input thereto, MOSFET Q101 turns on. This, in turn, causes triac TH101 to be turned on as well, resulting in ignition of lamps L3 and L4. When the voltage supply to the gate of MOSFET Q101 is zero, MOSFET Q101 is off, as are triac TH101 and lamps L3 and L4. Thus, the voltage level at the gate of MOSFET Q101 controls the lighting of lamps L3 and L4.

MOSFET Q101 is driven, for example, by flip-flop IC1-B, which is half of dual D flip-flop IC1. A dual D flip-flop suitable for use as IC1 is the MC14013. Diode D102 and capacitor C102 provide a DC power supply for dual D flip-flop IC1. Capacitor C103 and resistor R104 provide a narrow pulse which sets flip-flop IC1-B's Q output to high when the DC power supply is ramping up. Since the Q output of flip-flop IC1-B controls MOSFET Q101, and hence triac TH101, all 4 lamps will turn on when the main power turns on and prior thereto there was insufficient DC power to operate IC1.

Advantageously, to drive a MOSFET requires almost no current. Likewise, an MC14013 dual D flip-flop chip, since it is a CMOS integrated circuit, consumes very little current. Thus, the power supply for IC1 can sustain itself for a certain amount of time, which mainly is a function of the values of capacitor C102 and resistor R103. The values of capacitor C102 and resistor R103 are selected, for example, such that sufficient DC power is supplied to operate IC1 for approximately 5 seconds after the ballast input power is turned off. This means that IC1 can perform its normal functions within a 5 second window after the loss of power at the output of ballast transformer T21, which occurs when switch S1 is toggled.

Since IC1 is operable for 5 seconds after power at the output of ballast transformer T21 is turned off, the status of ballast output transformer T21 can be used as the clock signal to drive D flip-flop IC1-B. For example, no output from transformer T21 means a logic "0" and an output from transformer T21 represents a logic "1". If wall switch S1 is turned off and then turned on within 5 seconds, D flip-flop IC1-B will change its output status once, which occurs at the transition from "0" to "1". Doing so causes the on/off status of triac TH101 and lamps L3 and L4 to change.

Although using a triac to control alternating current (AC) devices is known in the art, such use is limited to only low frequency applications, e.g., where the AC power frequency is lower than 400 Hz. This is because, as is known in the art, a triac controlling high frequency AC power may not operate as desired. For instance, a triac is supposed to turn off automatically when the AC current being controlled by the triac, namely, the AC current through the triac, crosses zero and no trigger signal, which is the control signal for a triac, is present. However, a triac that is controlling high frequency AC power may not do so. Instead, once a triac controlling high frequency AC power turns on, it may stay on when the current which is passing through, and being controlled by, the triac crosses zero and there is no trigger signal, even though it is not supposed to.

Such undesired triac operation is known as "commutation failure". Commutation failure occurs when the reverse recovery current, due to unrecombined charge carriers of one of the thyristors in the triac as it turns off, acts as a gate current to trigger the other thyristor in the triac into conduction as the voltage rises in the opposite direction. The probability of any triac undergoing commutation failure is dependent on the rate of rise of the reverse voltage (dV/dt) and the rate of decrease of conduction current (dI/dt). The higher the dI/dt, the more unrecombined charge carriers that are left at the instant of turn-off. The higher the dV/dt, the more probable it is that some of these charge carriers will act as a gate current to trigger the triac into conducting.

Thus, the commutation capability of a triac, i.e., the limits up to which the triac can be operated before commutation failure will occur, is usually specified in terms of the turn-off dI/dt and the re-applied dV/dt that the triac can withstand at any particular junction temperature. For use in controlling the current to lamps L3 and L4 according to the invention, $(dI/dt)_c$=80 A/mS and $(dV/dt)_c$=170 V/uS, where c indicates commutation. But for conventional triacs, even ones such as the MAC8N, available from Philips Semiconductors, which are designed to have a high commutation capability, the commutation capability is specified as being only $(dI/dt)_c$= 6.5 A/mS and $(dV/dt)_c$=18 V/uS. Clearly, such a commutation capability is insufficient to prevent commutation failure when the triac is used under the conditions which are required in order to control the current to lamps L3 and L4, and one would not expect such a triac to operate properly under such circumstances.

The foregoing notwithstanding, in accordance with a principle of the invention, the frequency of the AC power being controlled by triac TH101, namely the output from ballast output transformer T21, is greater than 400 Hz, e.g., 20 KHz or more, and without requiring a snubber network. Indeed, we have recognized that, unlike other prior art triac applications, the undesirable triac behavior which results from commutation failure is not a problem when a triac is used for lamp control according to the invention. This is because, after the triac is turned on, the triac never has to turn off before the AC power it is controlling is turned off at another point by some other control, e.g., a switch at a different location. In other words, when the main power to the ballast is turned off, e.g., upon any opening of wall switch S1 (FIG. 1)—either to keep all the lamps off or as part of a toggle—, the output of ballast output transformer T21, which is supplying the power being controlled, becomes zero. This in turn causes triac TH101, and hence lamps L3 and L4, to turn off, because there is no longer any current available to pass through the triac. In the case of a toggle, since the triac turned off in response to the wall switch opening, when the wall switch is closed again—thus causing the trigger signal to be removed and high frequency AC power to reappear at the output of ballast output transformer T21—, the triac need merely stay off in the presence of the AC power to keep lamps L3 and L4 off. As such, in accordance with an aspect of the invention, at the high AC power frequency the triac employed need meet only the off-state dV/dt specification.

Conventionally, the voltage across the triac is around 600 $V_{peak}$. As such, it is well below a conventional voltage rating for a triac, which is around 800 $V_{peak}$. Nevertheless, fast recovery diodes D105 and D106 are employed to protect triac TH101 against any transient voltage spikes that exceed its rated voltage. Such transient voltage spikes may occur during the turn on stage of ballast B1.

When IC1 is implemented as an MC14013, its clock input has a special requirement, namely, the rise and fall times of the clock input should not exceed 15 microseconds when the DC power supply voltage is 5 volts. Otherwise, flip-flop IC1-B may not operate properly. Unfortunately, the signal from transformer T21, which one would desire to use as the clock input signal, does not meet this requirement. Therefore, its waveform must be cleaned prior to being supplied to the clock input of IC1-B.

Figure 4:
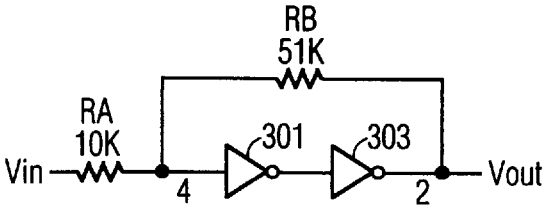
Figure 5:
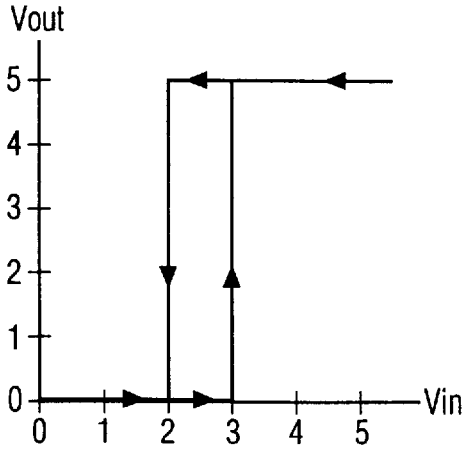

A conventional method of cleaning a slow signal is to use a Schmitt trigger integrated circuit, such as a 74HC14. The threshold of the Schmitt trigger is employed to guarantee a clean, sharp output waveform. However, to make use of such a Schmitt trigger integrated circuit would require that the system include a second integrated circuit, which would increase the system's cost. Instead of doing so, in accordance with an aspect of the invention, since the MC14103 has two D flip-flops in one package, the other, previously unused D flip-flop of the MC14013 is configured to operate as a Schmitt trigger. How this is achieved is shown in FIGS. 3, 4, and 5.

Figure 3:
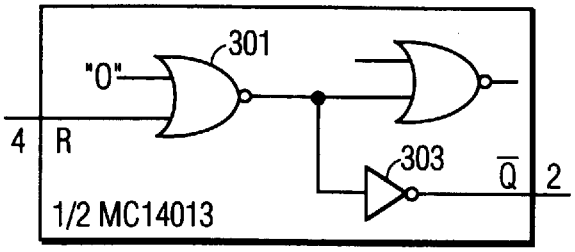
FIGS. 3, 4, and 5 show how to employ a flip-flop to construct a Schmitt trigger, in accordance with an aspect of the invention.

FIG. 3 shows the internal configuration of an MC14013. Between Pins 4 and 2 is NOR gate 301 and inverter 303. If the other input, i.e., the one not connected to Pin 4, of NOR gate 301 is held at a logic "0", NOR gate 301 acts as an inverter for the signal supplied to Pin 4. The resulting equivalent circuit of coupled inverters is shown in FIG. 4. Also shown in FIG. 4 are 2 resistors, RA and RB, which are added between Pin 2 and Pin 4 to create a circuit which functions as a Schmitt trigger. The input/output characteristic of the resulting Schmitt trigger circuit is shown in FIG. 5. Note that R106 of FIG. 2 corresponds to RA of FIG. 5 and that R107 of FIG. 2 corresponds to RB OF FIG. 5.

The output signal of ballast transformer T21, which is equivalent to the status of wall switch S1 (FIG. 1), is rectified by diode D101 and filtered by capacitor C101 prior to being supplied to the Schmitt trigger input. The output of the Schmitt trigger is supplied to the clock input of D flip-flop IC1-B.

Conventionally, the output of a ballast transformer is not an ideal voltage source. When the output load is heavy, the output voltage will drop. Thus, in the embodiment of the invention shown in FIG. 2, the light output of lamps L1 and L2 will increase if lamps L3 and L4 are turned off. This means that the main power which is input to the ballast may not be reduced by 50% when half of the lamps are off.

Figure 6:
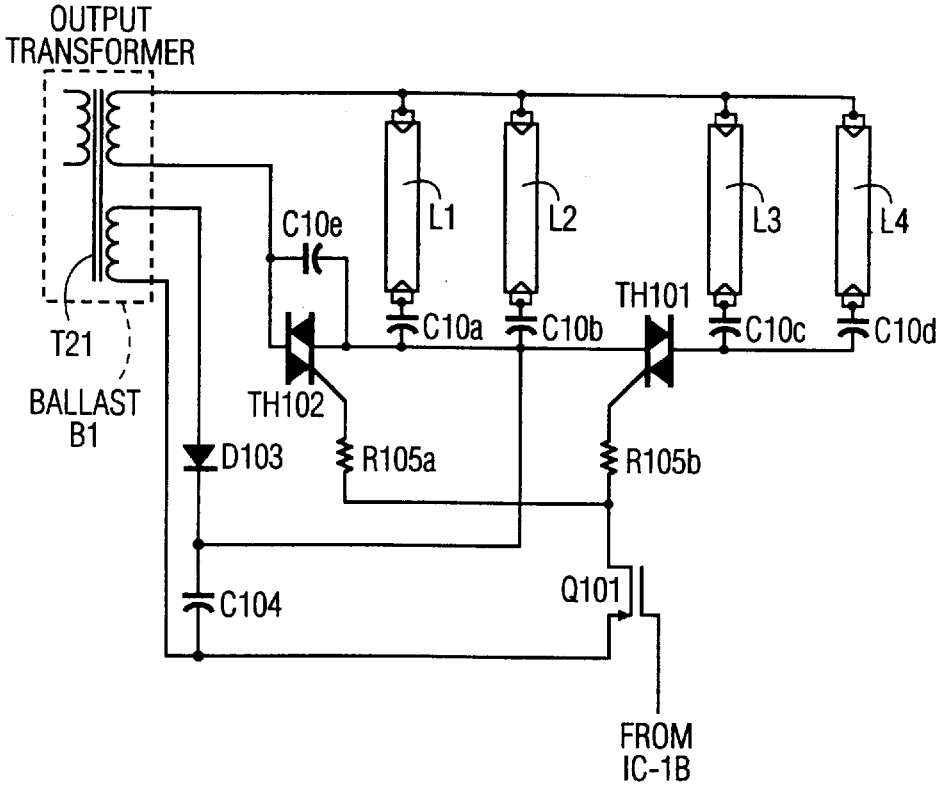
FIG. 6 shows a modified version of the FIG. 2 embodiment of the invention which may be used to insure that a 50% input power reduction will result when half of the lamps are off.

To be certain that a 50% input power reduction will result when half of the lamps are off, a modified version of the FIG. 2 embodiment of the invention may be used. Such a modified embodiment of the invention is shown in FIG. 6. In particular, triac TH102 and capacitor C101E are added to the FIG. 2 embodiment of the invention. As with triac TH101, triac TH102 is also controlled by MOSFET Q101, so that triacs TH101 and TH102 both turn on or off at the same time. To give each of triacs TH101 and TH102 substantially equal trigger currents, resistor R105 of FIG. 2 is divided into resistors R105A and R105B of FIG. 6.

Operationally, when triacs TH101 and TH102 are on, capacitor C10E is shorted and each of lamps L1, L2, L3 and L4 have substantially the same drive voltage. When triacs TH101 and TH102 are off, lamps L3 and L4 are both off and capacitor C10E is connected in series with capacitors C10A and C10B. Careful selection of the value of C10E will meet the 50% power reduction requirement.

For a rapid start ballast, the configuration of FIG. 6 can be simplified by a) removing resistor R105B, b) removing triac TH101 (short TH101's anode and cathode), and c) selecting a proper value for capacitor C10E. Advantageously, all 4 lamps can be dimmed to a desired lower level. The four lamps are fully lighted when TH102 turns on, otherwise the 4 lamps are dimmed to a desired lower level because of current limiting by C10E when TH102 turns off.

Table 1 is a listing of exemplary components that can be used to implement the invention. The components are listed in association with their reference identifier.

TABLE 1

| REFERENCE IDENTIFIER | PART NUMBER |
|---|---|
| TH101 | MAC8N |
| TH102 | MAC8N |
| IC101 | MC14013 |
| Q101 | 2N7000 |
| D101, D202, D103 | 1N4148 |
| D105, D106 | BYV95C |
| R101 | RCF, 30, 1/8W, 5% |
| R102 | RCF, 10K, 1/8W, 5% |
| R103, R104 | RCF, 200K, 1/8W, 5% |
| R105A, R105B | RCF, 100 1/2W, 5% |
| R106 | RCF, 10K, 1/8W, 5% |
| R107 | RCF, 51K, 1/8W, 5% |
| C101, C103 | CPC, 0.1 uF, 50V |
| C102 | CPT, 22 uF, 10V |
| C104 | CPE, 22 uF, 10V |
| C10A, C10B, C10C, C10D | CPP, 0.0025 uF, 3KV |
| C10E | CPP, 0.01 uF, 1KV |

By applying the principles of the invention and employing additional logic circuitry, e.g., counters, gates, and the like, as well as additional triacs and drive transistors, those of ordinary skill in the art will recognize how to create a lamp control circuit for connection to a single ballast which displays, as the power switch is toggled, a sequence of lamp lighting patterns on the multiple lamps driven by the ballast.

Also, several ballasts that are connected to a single power switch may have additional logic in their lamp control circuits according to the invention so that the circuits are programmable, e.g, using one or more jumpers in each circuit, as to their individual lamp lighting pattern sequence. Consequently, as the power switch is toggled multiple times, an overall sequence of lamp lighting patterns results. This sequence is changeable by changing the programming of one or more of the lamp control circuits. In one such embodiment, upon each completed toggle the number of toggles that have taken place is counted by the circuit of each ballast, e.g., on a modulo basis, and then each circuit makes an individualized determination, as a function of the number of toggles and its jumper settings, regarding which of its lamps it lights.

The foregoing merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. A lighting control circuit comprising:

a triac for controlling the coupling of power supplied from a ballast to at least one of a plurality of lamps, said ballast being connected to a wall switch for receiving main power; and means for turning said triac on or off in response to a toggling of said wall switch, wherein said triac operates independent of any snubber network.

2. The invention as defined in claim 1 wherein said means for turning said triac on or off comprises a flip-flop.

3. The invention as defined in claim 1 wherein said means for turning said triac on or off comprises a transistor.

4. The invention as defined in claim 3 wherein said transistor is a metal oxide semiconductor field effect transistor.

5. The invention as defined in claim 1 further comprising:

a control unit for determining which, if any, of said lamps of said plurality, are to be lit; and a power switch, responsive to said control unit, for coupling power to said determined lamps, wherein said power switch and said control unit are coupled to an output of said ballast.

6. The invention as defined in claim 5 further comprising a power supply for said control unit, and wherein said ballast is connectable to a main power source, said control unit power supply supplies sufficient power to operate said control unit for a predetermined amount of time after said ballast is disconnected from said main power source.

7. The invention as defined in claim 5 wherein said ballast is connectable to a main power source and wherein said control unit determines which, if any, of said lamps are lit in response to each connection of said ballast to said main power source.

8. The invention as defined in claim 5 wherein said control unit performs its determining in response to information external to said control unit, said information being received only via said output of said ballast.

9. The invention as defined in claim 5 wherein said ballast is connectable to a main power source and wherein, when said main power source is toggled off and then back on again within a predetermined amount of time, said toggling being initiated when predetermined ones of said lamps are lit as per said control unit, said control unit determines that said predetermined lamps and at least one more of said lamps are to be lit.

10. The invention as defined in claim 5 wherein said ballast is connectable to a main power source and wherein, when said main power source is toggled off and then back on again within a predetermined amount of time, said toggling being initiated when a predetermined ones of said lamps are lit as per said control unit, said control unit determines to turn off at least one of said predetermined ones of said predetermined lamps.

11. The invention as defined in claim 5 wherein said ballast is connectable to a main power source and wherein, when said main power source is toggled off and then back on again within a predetermined amount of time, said toggling being initiated when all of said lamps are lit, said control unit determines to turn 50% of said lamps off.

12. The invention as defined in claim 5 wherein said ballast is connectable to a main power source and wherein, when said main power source is toggled off and then back on again within a predetermined amount of time, said toggling being initiated when 50% of said lamps are lit, said control unit determines to turn all of said lamps on.

13. Apparatus for controlling application of alternating current (AC) power at a frequency greater than 400 Hz and a voltage greater than 240 V to a load, said AC power being derived by a generator using energy from a main power source, comprising:

means for inhibiting the flow of said AC power in response to a control signal; and means for supplying said control signal to said means for inhibiting, each initiation of supplying of said control signal being only when said main power source is disconnected from said generator.

14. A method for controlling the application to a load of AC power at a frequency via a triac which has a commutating dv/dt rating at said frequency and an off-state dv/dt rating at said frequency, the method comprising the steps of:

when said triac is conducting, turning said triac off only by turning said AC power off;

applying a conduction inhibit signal to said triac prior to or substantially concurrent with turning said AC power on only when said triac had been not conducting substantially immediately prior to a latest preceding turning off of said AC power; and applying a conduction signal to said triac when said triac had been not conducting either substantially immediately prior to a latest preceding turning off of said AC power or when said AC power was off for more than a predetermined period of time.

15. A method for controlling the application to a load of AC power at a frequency via a triac which has a commutating dv/dt rating at said frequency and an off-state dv/dt rating at said frequency, the method comprising the steps of:

when said triac is conducting, turning said triac off only by turning said AC power off;

applying a conduction signal to said triac prior to or substantially concurrent with turning said AC power on only when said triac had been not conducting substantially immediately prior to a latest preceding turning off of said AC power; and applying a conduction inhibit signal to said triac when said triac had been conducting either substantially immediately prior to a latest preceding turning off of said AC power or when said AC power was off for more than a predetermined period of time.

16. A method for controlling the application to a load of AC power at a frequency via a triac which has a commutating dv/dt rating at said frequency and an off-state dv/dt rating at said frequency, the method comprising the steps of:

when said triac is conducting, turning said triac off only by turning said AC power off;

applying a conduction inhibit signal to said triac prior to or substantially concurrent with turning said AC power on only when said triac had been not conducting substantially immediately prior to a first predefined number of preceding turnings off of said AC power; and applying a conduction signal to said triac when said triac had been not conducting either substantially immediately prior to a second predefined number of preceding turnings off of said AC power or when said AC power was off for more than a predetermined period of time.

17. The invention as defined in claim 16 wherein said first predefined number is programmable.

18. The invention as defined in claim 16 wherein said second predefined number is programmable.

19. A method for controlling the application to a load of AC power at a frequency via a triac which has a commutating dv/dt rating at said frequency and an off-state dv/dt rating at said frequency, the method comprising the steps of:

when said triac is conducting, turning said triac off only by turning said AC power off;

applying a conduction inhibit signal to said triac prior to or substantially concurrent with turning said AC power on only when said triac had been not conducting substantially immediately prior to any of a first plurality of predefined numbers of preceding turnings off of said AC power; and applying a conduction signal to said triac when said triac had been not conducting either substantially immediately prior to any of a second plurality of predefined numbers of preceding turnings off of said AC power or when said AC power was off for more than a predetermined period of time.

20. The invention as defined in claim 19 wherein said numbers of said first plurality are selectable via programming.

21. The invention as defined in claim 19 wherein said numbers of said second plurality are selectable via programming.

22. A method for controlling the application to a load of AC power at a frequency via a triac which has a commutating dv/dt rating at said frequency and an off-state dv/dt rating at said frequency, the method comprising the steps of:

when said triac is conducting, turning said triac off only by turning said AC power off;

applying a conduction inhibit signal to said triac prior to or substantially concurrent with turning said AC power on only when said triac had been not conducting substantially immediately prior to any of one or more predefined numbers of preceding turnings off of said AC power; and applying a conduction signal to said triac when said triac had been not conducting either substantially immediately prior to a second predefined number of preceding turnings off of said AC power or when said AC power was off for more than a predetermined period of time.

23. A lighting control circuit comprising:

a triac for controlling the coupling of power supplied from a ballast to at least one of a plurality of lamps, said ballast being connected to a wall switch for receiving main power; and means for turning said triac on or off in response to a toggling of said wall switch, wherein said power supplied to said triac has a frequency greater than 400 Hz, said triac operates independent of any snubber network, and said means for turning controls said triac to prevent commutation failure.

24. The invention as defined in claim 23 wherein said power supplied to said triac has a frequency greater than 15,000 Hz.

* * * * *